United States Patent [19]

Tavolieri

[11] Patent Number: 4,985,994

[45] Date of Patent: Jan. 22, 1991

[54] FOLDING HANDLE FOR TWIN BLADE CARTRIDGE

[76] Inventor: George Tavolieri, 222 N. Calle El Segundo #532, Palm Springs, Calif. 92262

[21] Appl. No.: 414,296

[22] Filed: Sep. 29, 1989

Related U.S. Application Data

[63] Continuation-in-part of Ser. No. 200,725, May 31, 1988.

[51] Int. Cl.[5] ..... B26B 21/00

[52] U.S. Cl. ..... 30/47; 30/85

[58] Field of Search ..... 30/47, 85, 86, 32; D28/45, 46, 47, 48; 16/110 R

[56] References Cited

U.S. PATENT DOCUMENTS

| | | | |
|---|---|---|---|
| D. 281,025 | 10/1985 | Hindson | D28/46 |
| 2,699,602 | 1/1955 | Finley | 30/47 |
| 2,871,560 | 2/1959 | Eberbaugh | 30/47 |
| 3,750,280 | 8/1973 | LePaliscot et al. | 30/85 |
| 4,245,389 | 1/1981 | Trotta | 30/47 |
| 4,275,498 | 6/1981 | Ciaffone | 30/47 |
| 4,439,920 | 4/1984 | Nauheimer | 30/47 |
| 4,712,301 | 12/1987 | Saito | 30/47 |

*Primary Examiner*—Hien H. Phan
*Assistant Examiner*—Rinaldi Rada
*Attorney, Agent, or Firm*—Laubscher Presta & Laubscher

[57] ABSTRACT

A disposable razor handle is formed by folding a blank having a base, flexible connecting throat, intermediate, and head portions, snap-fastener devices being provideed for securing together the opposed side panels of the base and intermediate portions, the side panels of the flexible connecting throat portion being spaced and independent of each other. Longitudinal stabilizing panels are connected with the free edges of, and are arranged normal to, the base side panels, and linear indentations are provided in the outer surfaces of at least one of the connecting side panels thereby to impart flexibility thereto.

1 Claim, 1 Drawing Sheet

FIG. 1
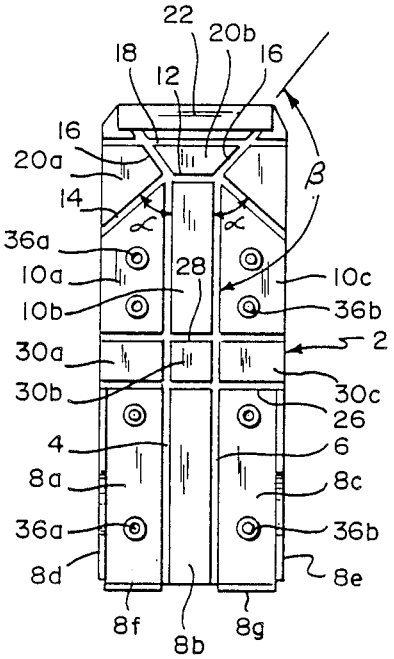
FIG. 2
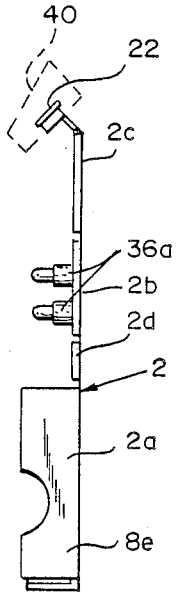
FIG. 3
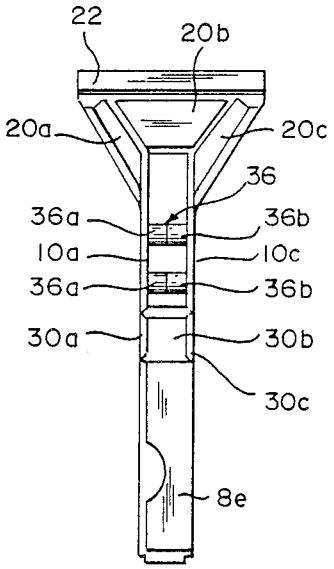
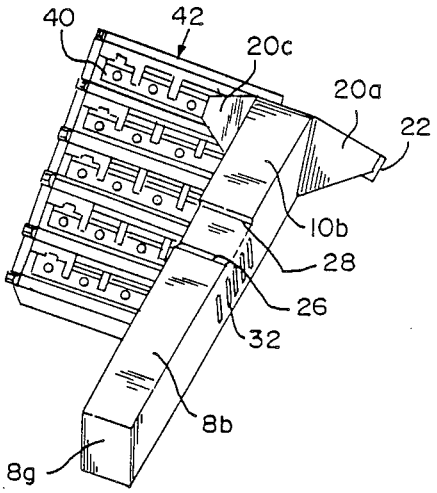
FIG. 4
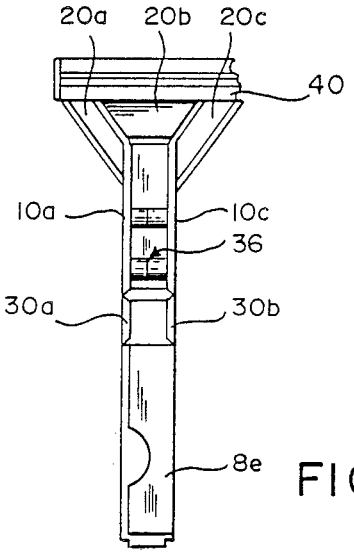
FIG. 5
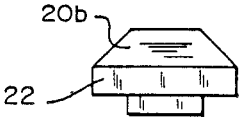
FIG. 6
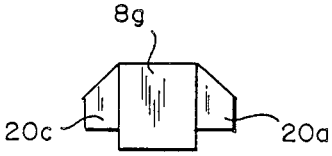
FIG. 7

FOLDING HANDLE FOR TWIN BLADE CARTRIDGE

REFERENCE TO PRIOR APPLICATION

This application is a continuation-in-part of Ser. No. 07/200,725 filed May 31, 1988.

BRIEF DESCRIPTION OF THE PRIOR ART

It is well known in the prior art to provide disposable razors including a handle formed of synthetic plastic material or the like.

The present invention was developed to provide a rectangular blank of synthetic plastic material for aluminum that is foldable for assembly to define a razor handle to which a twin blade cartridge may be slidably connected. Examples of such handles in the patented prior art are the patents to Saito No. 4,712,301, Hindson Design Patent No. 281,205 and Nauheimer No. 4,439,920.

One problem experienced with the disposable razor handles of the prior art is the difficulty and complexity of manually snapping together the portions of the foldable blank from which the handle is formed, thereby to produce a rigid permanent handle. More particularly, the rigid panel portions are provided with cooperating male and female snap fasteners, respectively, which often require an appreciable degree of manual dexterity and strength to assemble, particularly in the throat area of the handle.

The present invention was developed to provide an improved disposable razor blade handle having inherent flexibility in the throat area of the handle, thereby to improve the manual assembly of the handle from a foldable synthetic plastic blank.

SUMMARY OF THE INVENTION

Accordingly, a primary object of the invention is to provide a foldable blank having base, intermediate and head portions, said base and intermediate portions each having a center panel and a pair of side panels, fastener means being provided for fastening together the side wall panels when arranged normal to the associated center panel, respectively, characterized in that said base portion includes also stabilizing panels that overlap when the base and intermediate side walls are fastened together, and said intermediate portion includes a relatively flexible connecting throat portion that facilitates connection of the fastener means. More particularly, the flexible connecting throat portion is provided between the base and intermediate portions, the side walls of said flexible connecting portion being independently spaced from each other. The head portion includes a trapezoidal center panel that carries a cartridge mounting panel, and a pair of triangular side panels that support the center and mounting panels when the intermediate side panels are fastened together, thereby to permit sliding insertion of the mounting panel in the corresponding mounting slot contained in a twin blade cartridge.

BRIEF DESCRIPTION OF THE DRAWING

Other objects and advantages of the invention will become apparent from a study of the following specification when viewed in the light of the accompanying drawing, in which:

FIGS. 1 and 2 front elevation and side views, respectively, of the foldable razor handle blank of the present invention;

FIG. 3 is a bottom elevational view of the blank when in the folded condition to define a handle;

FIG. 4 is a perspective view illustrating the manner in which the handle of FIG. 3 is connected with one twin blade cartridge of a package of cartridges;

FIG. 5 is a bottom elevational view illustrating a twin blade cartridge connected with the handle of the present invention; and FIG. 6 and 7 are end views of the head and base ends, respectively, of the handle of FIG. 3.

DETAILED DESCRIPTION

Referring first more particularly to FIGS. 1 and 2, the foldable blank 2 is formed from a suitable synthetic plastic material or aluminum and includes base, intermediate and head portions 2*a*, 2*b* and 2*c*, respectively, and a flexible connecting throat portion 2*d* between the base and intermediate portions. A pair of spaced longitudinal fold lines 4 and 6 contained in the base and intermediate portions define a center base panel 8*b* and a pair of base side panels 8*a* and 8*c*, and a center intermediate panel 10*b* and a pair of intermediate side panels 10*a* and 10*c*. A transverse first fold line 12 extends between first ends of the longitudinal fold lines adjacent the head portion, and a pair of second fold lines 14 extend outwardly at an acute angle $\alpha$ to the longitudinal fold lines, respectively. A pair of third fold lines 16 extend at an obtuse angle $\beta$ to the longitudinal fold lines, and a transverse fourth fold line 18 extends between third fold lines to define a trapezoidal central head panel 20*b*, and a pair of generally triangular head side panels 20*a*, 20*c*. Transverse mounting panel 22 is connected with fold line 18 and extends at an angle relative to the trapezoidal center panel 20*b*.

Longitudinal handle stabilizing panels 8*d*, 8*e* extend normal to the free longitudinal edges of base side panels 8*a* and 8*c*, respectively, and end panels 8*f* and 8*g* extend normal to the end edges of the base side panels. The heights of the stabilizing and end panels correspond generally with the width of the center base panels 8*b*. Fifth and sixth transverse fold lines 26 and 28 define between the base and intermediate portions of the handle a center connecting panel 30*b*, and a pair of connecting side panels 30*a*, 30*c*. As shown in FIG. 4, the outer surfaces of the connecting side wall panels contain a plurality of linear indentations 32 that extend parallel with the transverse fold lines 26 and 28, thereby imparting to the connecting throat portion 2(*d*) a desired degree of flexibility for facilitating the manual fastening of the panels, as will be described below.

In accordance with a characterizing feature of the present invention, the blank of FIG. 1 can be folded to form the razor handle of FIG. 3 by bringing the side panels of the base and intermediate portions to positions normal to their associated center panels 8*b* and 10*b*, respectively, whereupon the stabilizing and end panels (8*d*, 8*e* and 8*f*, 8*g*, respectively) are in overlapping relation. Snap-fastener means 36 including cooperating female and male snap-fastener components 36*a*, 36*b* on the adjacent faces of the base and intermediate side wall panels are provided for fastening these walls together, whereby the triangular head side walls 20*a* 20*c* are brought to angularly arranged positions to support the transverse mounting panel 22 for insertion within the corresponding mounting slot contained in a twin blade cartridge 40 of a cartridge package 42, as shown in FIG. 4. Owing to the flexibility imparted to the throat area 2*d* by the indentations 32 in the walls 30*a* and 30*b*, the fastening of the fasteners 36*a* and 36*b* is facilitated. The assembled razor, as shown in FIG. 5, is then ready for use.

What is claimed is:

1. A disposable razor handle for use with a twin blade cartridge containing a longitudinally extending mounting slot, comprising:

a generally rectangular foldable blank (2) formed of synthetic plastic material and including base (2*a*), intermediate (2*b*), head (2*c*) portions, said blank also including a connecting portion (2*d*) between said base and intermediate portions, (1) said blank containing a pair of spaced longitudinal fold lines (4,6) extending successively the length of said base, said connecting and said intermediate portions and defining in each thereof a center panel (8*b*, 30*b*, 10*b*) arranged between a pair of side panels (8*a*, 8*c*,; 30*a*, 30*c*; 10*a*, 10*c*);

(2) said blank containing a transverse first fold line (12) extending between first ends of said longitudinal fold lines adjacent said head portions, a pair of second fold lines (14) extending outwardly at an acute angle ($\alpha$) from said first ends of said longitudinal fold lines, a pair of third fold lines (16) extending outwardly at an obtuse angle ($\beta$) from said first ends of said longitudinal fold lines, a transverse fourth fold line (18) extending between said third fold lines and cooperating to form in said head portion a trapezoidal central panel portion (20*b*), said second and third fold lines cooperating to define generally triangular side panels (20*a*, 20*c*) in said head portion;

(3) a pair of longitudinal handle stabilizing panels (8*d*, 8*e*) connected with the free edges of, and extending normal to one side of, said base side panels, respectively, the height of each of said stabilizing panels being generally equal to the width of said center base panel;

(4) a pair of base end panels (8*f*, 8*g*) secured to the free ends of, and arranged normal to, said one side of said base side panels, respectively, the height of each of said end panels being generally equal to the width of said center base panel;

(5) a transverse blade mounting panel (22) connected with said transverse fourth fold line and arranged at an angle relative to said trapezoidal central head panel portion;

(6) said blank further containing spaced transverse fifth (26) and sixth (28) fold lines cooperating with said longitudinal fold lines to define said center connecting panel (30*b*) and said pair of spaced independent connecting side panels (30*a*, 30*c*);

(7) first means operable when said intermediate side panels are folded to positions normal to said intermediate base panel for fastening together said intermediate side panels, thereby causing:

(a) said triangular head side panels to support said blade mounting panel for slidable insertion within said cartridge mounting slot, and (b) said connecting side walls to be in spaced independent relation relative to each other without any connecting means extending therebetween;

(8) second means operable when said base side panels are folded to positions normal to said base center panel for fastening together said base side panels, thereby causing said stabilizing panels and said end panels to be in overlapping relation, respectively;

(9) said first and second means for fastening together said base side panels and said intermediate side panels comprising cooperating male and female snap fastener means (36*a*, 36*b*) on adjacent faces of said base and intermediate side panels, respectively, the adjacent faces of said connecting side panels, when said blank is in the folded condition, being planar and unadorned; and

(10) means imparting flexibility to said connecting side panels to facilitate manual connection of said first and second fastening means, respectively, comprising a plurality of linear indentations (32) contained in the outer surfaces of said connecting side panels and extending generally parallel with said fifth and sixth transverse fold lines.

* * * * *